United States Patent [19]

Watanabe

[11] Patent Number: 4,498,875

[45] Date of Patent: Feb. 12, 1985

[54] OUTBOARD MOTOR

[75] Inventor: Eifu Watanabe, Hamamatsu

[73] Assignees: Yamaha Hatsudoki Kabushiki Kaisha; Sanshin Kogyo Kabushiki Kaisha, both of Japan

[21] Appl. No.: 414,034

[22] Filed: Sep. 2, 1982

[30] Foreign Application Priority Data

Sep. 10, 1981 [JP] Japan ..... 56-142664

[51] Int. Cl.[3] ..... B63H 21/10

[52] U.S. Cl. ..... 440/88

[58] Field of Search ..... 440/88, 89, 900; 123/41, 31, 195 A, 198 E; 60/310

[56] References Cited

U.S. PATENT DOCUMENTS 3,310,022 3/1967 Kollman ..... 440/88

FOREIGN PATENT DOCUMENTS 831451 3/1960 United Kingdom ..... 440/88

1053503 1/1967 United Kingdom ..... 440/88

*Primary Examiner*—Trygve M. Blix
*Assistant Examiner*—Jesûs D. Sotelo
*Attorney, Agent, or Firm*—Ernest A. Beutler

[57] ABSTRACT

Two embodiments of water-cooled, four-cycle internal combustion engines used for outboard motors. In each embodiment, an arrangement is provided that offers a compact nature and which uses the coolant delivered to the engine for cooling the oil in the oil pan. In addition, an arrangement is provided whereby the exhaust pipe may pass through the oil pan and yet avoid significant heat transfer from the exhaust system to the lubricating system. In each embodiment of the invention, coolant is delivered to this clearance for further cooling the exhaust system. In one embodiment of the invention, an arrangement is provided for limiting the discharge of coolant from the clearance so as to maintain a level of coolant around the exhaust pipe.

8 Claims, 7 Drawing Figures

OUTBOARD MOTOR

BACKGROUND OF THE INVENTION

This invention relates to an outboard motor and more particularly to an improved cooling system for an outboard motor.

Outboard motors are normally powered by two-cycle engines because of the simplicity of these engines. However, there are many instances when it is desirable to employ a four-cycle internal combustion engine as the propulsion unit for an outboard motor. If a four-cycle engine is employed, it is necessary to provide an oil sump for the lubrication system of the engine. If the engine is mounted with its crankshaft extending vertically, as is the normal case with outboard motors, the oil sump is positioned externally of the engine. As is well known, the oil serves a cooling function in addition to a lubricating function. Continuous recycling of the oil during long periods of motor running can, however, cause the oil temperature to rise excessively and reduce the lubricating capabilities of the oil.

It is, therefore, a principal object of this invention to provide an improved lubricating and cooling system for a four-cycle internal combustion engine.

It is a further object of this invention to provide a lubricating system for a four-cycle outboard motor engine wherein the lubricant is cooled.

Because of the compact nature of outboard motors, when a four-cycle engine is employed, the exhaust system normally passes in close proximity to the oil pan or oil sump. As a result of this proximity, there is a danger that the lubricating oil, which as has been already noted is heated during engine operation, may be still further heated.

It is, therefore, a still further object of this invention to provide an improved exhaust and oil sump system for an internal combustion engine.

It is a further object of this invention to provide an exhaust and oil sump system for an outboard motor wherein transmission of heat from the exhaust system to the oil sump is minimized.

SUMMARY OF THE INVENTION

A first feature of this invention is adapted to be embodied in an outboard motor or the like that comprises an internal combustion engine having a water cooling jacket, an oil sump depending from the engine and defining a cavity for receiving lubricant from the engine. In accordance with the invention, a water passage extends at least in part through the cavity and is separated from the lubricant therein by a wall. The water passage is in communication with the engine water cooling jacket.

Another feature of this invention is adapted to be embodied in an outboard motor or the like comprising a power head having an internal combustion engine having an exhaust system including an exhaust outlet pipe. An oil sump depends from the engine and is adapted to contain lubricant. In accordance with this feature of the invention, the oil sump has a wall that defines a vertically extending opening. The exhaust pipe extends through the opening and is spaced inwardly from the wall to minimize the heat exchange between the exhaust pipe and the lubricant in the oil sump.

Yet another feature of this invention is adapted to be embodied in an outboard motor as set forth in the preceding paragraph. In accordance with this feature of the invention, a coolant conduit is also provided that discharges a portion of coolant into the gap between the oil pan and the exhaust pipe.

DETAILED DESCRIPTION OF THE PREFERRED EMBODIMENTS

Figure 1:
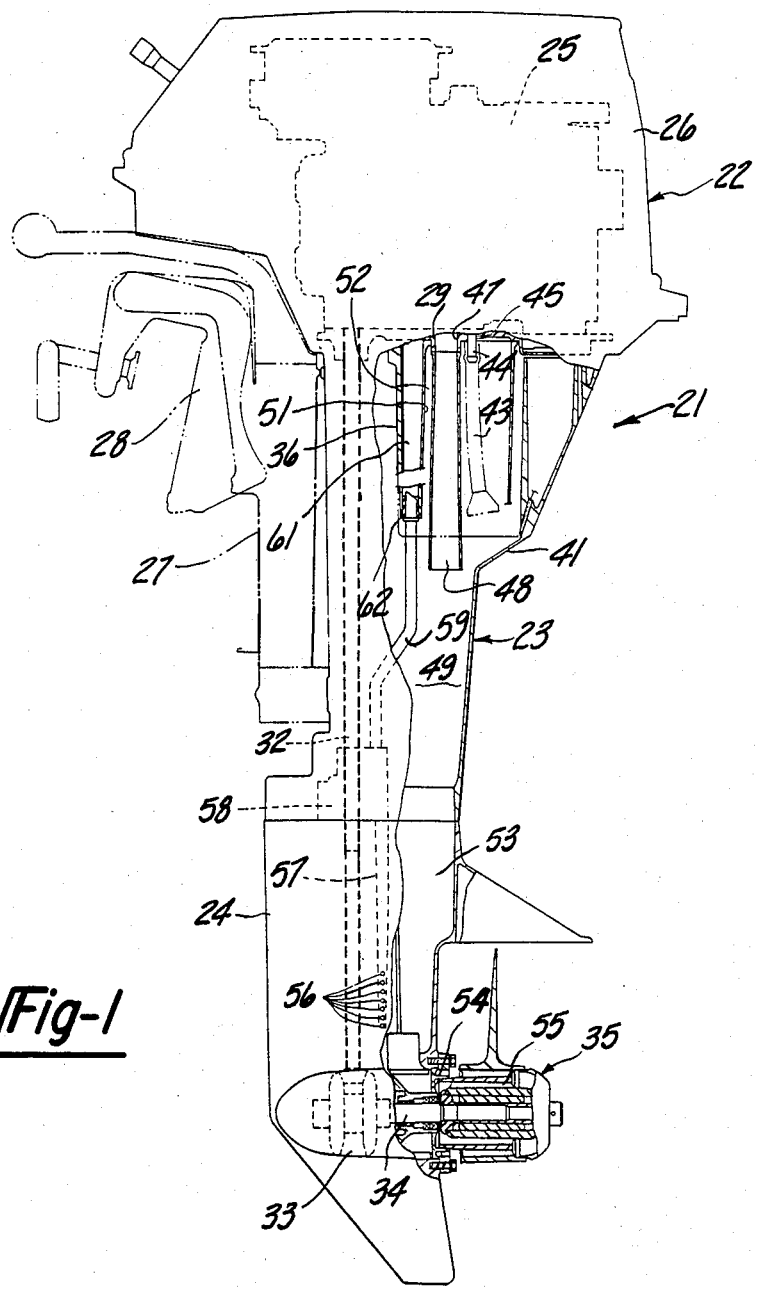
FIG. 1 is a side elevational view, with portions shown in section, of an outboard motor constructed in accordance with this invention.

Referring first to FIG. 1, an outboard motor constructed in accordance with this invention is identified generally by the reference numeral 21. The motor 21 includes a power head 22, driveshaft housing 23 and lower unit 24. The power head 22 includes a four-cycle water cooled internal combustion engine, indicated generally by the reference numeral 25 and shown in more detail in the remaining figures. A protective cowling 26 of a suitable type encircles the engine 25. The driveshaft housing portion of the engine is connected by means of a swivel bracket 27 to a transom clamp 28 so that the engine 21 may be affixed to the transom of a boat in a known manner.

The engine 25 may be of any suitable type and is illustrated as being a water-cooled, four-cycle internal combustion engine. Engine 25 is, as is normal with outboard motor practice, mounted with its crankshaft extending vertically. Since the internal details of the engine 25 form no part of the invention, they will not be described in detail. However, the engine embodies a cooling system that draws coolant from the body of water in which the motor 21 is operated, in a manner to be described. Also, an exhaust system and lubricating system including an external oil sump is provided. It is in connection with these components of the engine that the invention resides.

Referring now primarily to FIGS. 1 through 4, the engine 25 is supported on an exhaust guide and support plate 29 that extends across the upper portion of the driveshaft housing 23. The support plate 29 is, in turn, affixed to the driveshaft housing in a suitable manner as by bolts 31. A driveshaft 32 is affixed at its upper end for rotation with the crankshaft of the engine and extends downwardly through the driveshaft housing 23 and into the lower unit 24. At its lower end, the driveshaft 32 drives a forward/reverse/neutral transmission, shown in phantom in FIG. 1 and identified by the reference numeral 33, in a known manner. A propeller shaft 34 is affixed to the output shaft of the transmission 33 and drives a propeller 35 in a known manner.

Figure 2:
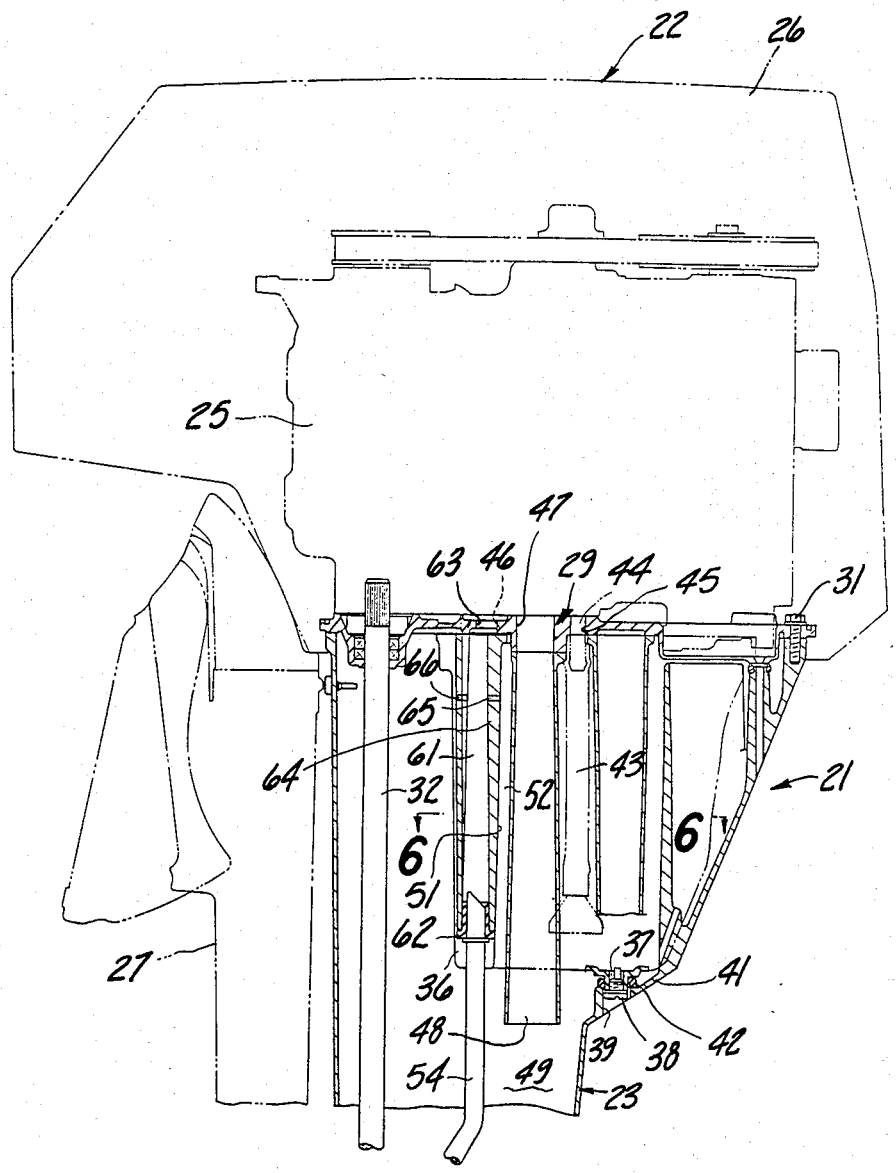
FIG. 2 is an enlarged view showing the upper portion of the driveshaft housing of the engine in cross-section and other components in phantom.
Figure 6:
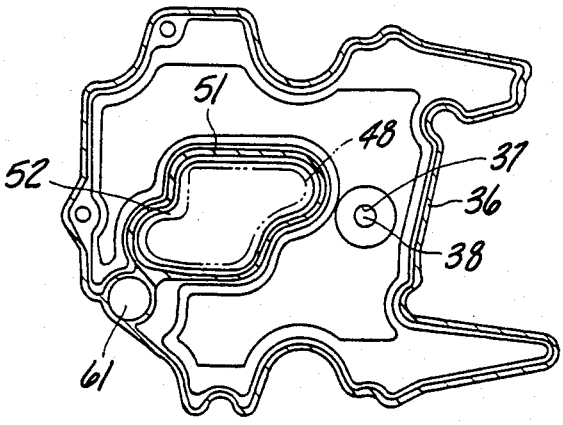
FIG. 6 is a cross-sectional view taken along the line 6—6 of FIG. 2.

The engine 25 is provided with a lubricating system that includes an oil pan 36 that is affixed to and depends from the underside of the support plate 29. The cross-sectional configuration of the oil pan along the plane 6—6 of FIG. 2 is shown in FIG. 6. The oil pan 36 is provided with a drain opening 37 at its underside that is closed by a drain plug 38. The opening 37 and drain plug 38 are accessible through an opening 39 formed in an inclined wall 41 of the driveshaft housing 23 (FIG. 2). An O-ring seal 42 surrounds the projection in which the oil pan opening 37 is formed and provides a seal between the oil pan 36 and the driveshaft housing wall 41.

Figure 3:
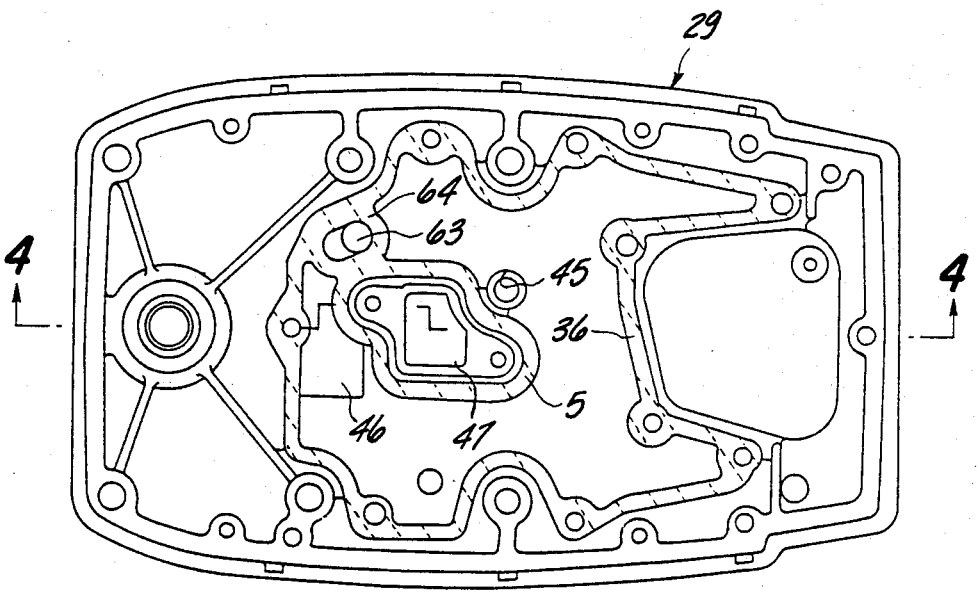
FIG. 3 is a bottom plan view of the supporting plate.
Figure 4:
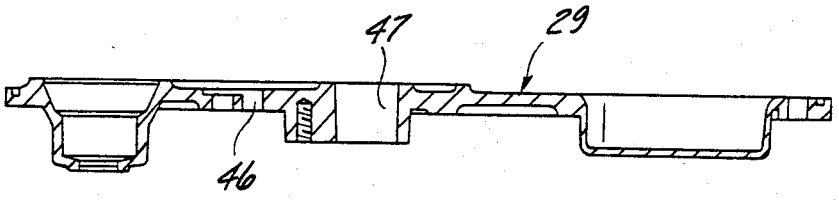
FIG. 4 is a cross-sectional view taken along the line 4—4 of FIG. 3.

An oil delivery tube 43 depends into the oil pan 36 from an oil inlet nipple 44 of the engine. The nipple 44, in turn, extends through an aperature 45 in the supporting plate 29. The nipple 44 is in communication with the lubricating system of the engine. As has been noted, the lubricating system of the engine per se forms no part of the invention and therefore has not been described in detail. Lubricant from the engine 25 is returned to the sump 36 through a drain hole 46 formed in the supporting plate 29 (FIGS. 2 through 4).

The exhaust system of the engine is of any known type and exhaust gases are discharged through a port (not shown) in the lower side of the engine adjacent the support plate 29. The engine exhaust port registers with an exhaust gas passage 47 of the support plate 29. An exhaust pipe 48 extends downwardly through a complementary enlarged opening formed in the oil pan 36 for discharge of the exhaust gases into an expansion chamber 49 of the driveshaft housing 23. This clearance in the oil pan 36 is provided by an upstanding wall 51 which surrounds the exhaust pipe 48 and is identified by the reference numeral 52.

The exhaust gases flow from the drive shaft housing expansion chamber 49 to a corresponding chamber 53 formed in the lower unit 24. The exhaust gases may then pass outwardly through exhaust gas discharges 54 in the rear wall of the lower unit 24 for discharge through axial extending passageways 55 of the propeller 35. Rather than using the hub type of exhaust as illustrated in FIG. 1, it is to be understood that the exhaust gases may be discharged through any suitable outlet as is well known in this art.

The cooling system for the engine 25 includes a plurality of vertically spaced water inlets 56 on opposite sides of the lower unit 24 that permit water to be drawn from the body in which the motor 21 is operating. These water inlets 56 supply a delivery pipe 57 from which, in turn, water is drawn by a coolant pump assembly 58 that is driven from the driveshaft 32 at an intermediate location and particularly at the area where the drive shaft housing 23 joins the lower unit 24. The coolant pump 58 discharges through a coolant delivery passage 59 which in turn discharges into a generally vertically extending coolant chamber 61 formed in the oil sump 36 in proximity to the lubricant therein. An elastic grommet 62 surrounds the pipe 54 at its upper end and provides a seal for the lower end of the coolant cavity 61. The coolant flows upwardly from the chamber 61 through a water delivery opening 63 formed in the support plate 29 for delivery to the cooling system of the engine 25, which, as has been noted, may be of any known type.

Figure 5:
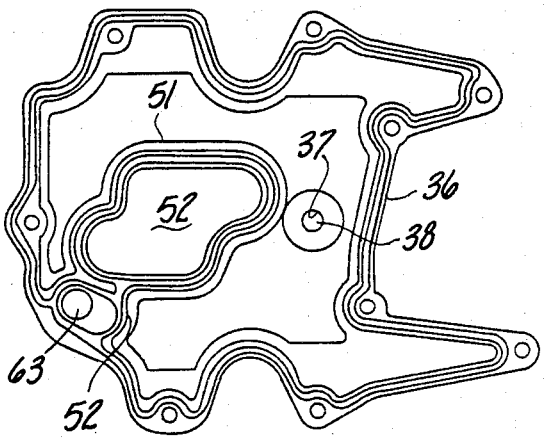
FIG. 5 is a top plan view of the oil pan of the engine.

In addition to serving the function of lubricating the engine, the lubricant also provides some cooling. As a result, the oil that is returned to the oil pan 36 through the oil drain 46 will have been heated. Although there will be some cooling of the oil in the sump 36 by its exposure to the surrounding air, at times this may be insufficient to provide the requisite degree of cooling. In accordance with the invention, a wall 64 surrounds the coolant cavity 61 and is in substantial heat exchanging relationship to the interior of the oil pan 36 as clearly shown in FIGS. 3, 5 and 6. Thus, there will be cooling of the oil by the coolant before it is delivered to the engine.

Although the exhaust pipe 48 is spaced by the gap 52 from the surrounding wall 51 of the oil pan 36, there may still be a possibility of heat transfer from the exhaust system to the lubricant in the sump 36. Additional assurance of avoiding the likelihood of heat transfer is provided by means of a cross drilled passageway 65 that extends through the coolant wall 51 and intersects the cavity 52. The outer end of the passage 65 is closed by a plug 66. As a result of the passageway 65, a portion of the cooling water delivered by the pump 58 will flow into the gap 52 so as to provide further cooling in this area. The water directed from the passage 65, will, in fact, impinge upon the exhaust pipe 48 due to its pressure so as to insure that this cooling will result.

Figure 7:
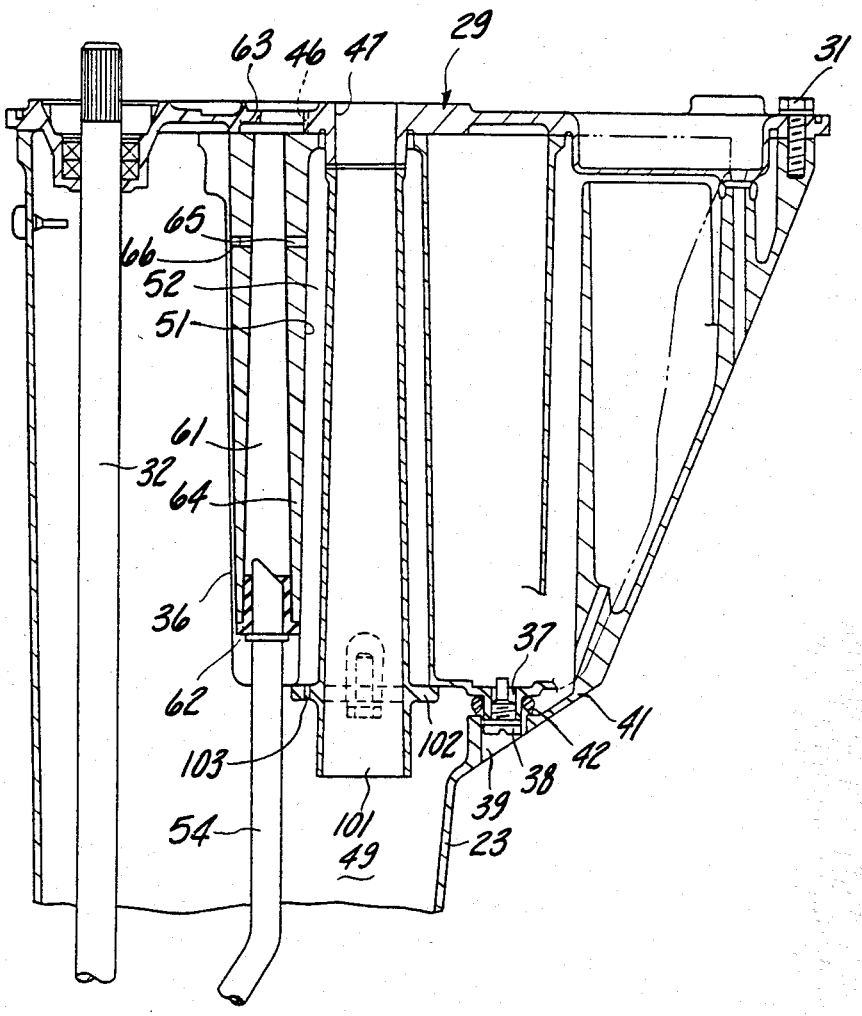
FIG. 7 is a cross-sectional view, in part similar to FIG. 2, showing a further embodiment of the invention.

FIG. 7 shows another embodiment of the invention where still further assurance of cooling of the exhaust gases and eliminating the transmission of heat to the lubricant in the oil pan 36 is insured. In this embodiment, only the construction of the exhaust pipe differs from the previously described embodiment and, for that reason, components which are the same as those of the previously described embodiment have been identified by the same reference numeral and will not be described again in detail, except insofar as is necessary to understand this embodiment of the invention.

In this embodiment, an exhaust pipe 101 is formed with an outstanding flange 102 near its lower end that engages the underside of the oil pan 36 around the cavity 52. Thus, the flange 102 in effect closes the cavity 52 so that water delivered to it by the passage 66 will accumulate. The amount of accumulation is limited by a hole 103 formed in the flange 102 so as to prevent the chamber 22 from becoming pressurized.

It should be readily apparent that two embodiments of the invention have been disclosed each of which is highly effective in providing a lubricating and cooling system for a four-cycle, water-cooled internal combustion engine that utilizes the engine coolant as a means for cooling the lubricant. In addition, even though the exhaust pipe passes through an opening in the oil pan, cooling in this area is provided so as to insure against the transmission of heat from the exhaust system to the lubricant in the oil pan. Although two embodiments of the invention have been disclosed, other changes and modifications may be made without departing from the spirit and scope of the invention, as defined by the appended claims.

I claim:

1. In an outboard motor or the like comprising a power head comprising an internal combustion engine having a cooling jacket and containing a coolant and an exhaust system including an exhaust outlet pipe, an oil sump depending from said engine and defining a cavity for receiving lubricant from said engine, the improvement comprising a water passage extending at least in part through said cavity and separated from the lubricant therein by wall means, said water passage being in communication with said engine cooling jacket and said oil sump having a wall encircling at least a portion of the length of said exhaust outlet pipe and defining a vertically extending opening through which said exhaust outlet pipe passes with a clearance therebetween to define a cooling air gap between said wall and said exhaust pipe for protecting the lubricant in said oil sump from the heat of the exhaust gases.

2. An outboard motor as claimed in claim 1 wherein the water passage extends vertically through the oil sump.

3. An outboard motor as claimed in claim 1 further including a coolant pump discharging under pressure into the water passage.

4. An outboard motor as claimed in claim 1 further including means for delivering a portion of the coolant from the water passage into the clearance between the oil sump and the exhaust pipe.

5. An outboard motor as claimed in claim 4 further including means for restricting the amount of discharge of the coolant delivered to the clearance.

6. In an outboard motor or the like comprising a power head having an internal combustion engine having an exhaust system including an exhaust outlet pipe, an oil sump depending from said engine and adapted to contain lubricant therefor, the improvement comprising said oil sump having a wall encircling at least a portion of the length of said exhaust outlet pipe defining a vertically extending opening therethrough, said exhaust outlet pipe extending through said opening and being spaced inwardly from said wall to minimize the heat exchange between said exhaust pipe and the lubricant in said oil sump.

7. An outboard motor as claimed in claim 6 further including means for delivering coolant to the clearance between the exhaust pipe and the oil sump wall.

8. An outboard motor as claimed in claim 7 further including means for restricting the discharge of coolant from the area between the exhaust pipe and the wall.

* * * * *